US010865752B2

(12) United States Patent
Rehwald et al.

(10) Patent No.: US 10,865,752 B2
(45) **Date of Patent: *Dec. 15, 2020**

(54) METERING VALVE FOR METERING A FLUID WHICH SERVES IN PARTICULAR FOR FUEL INJECTION SYSTEMS, MOUNTING SYSTEM FOR INJECTION SYSTEMS, AND INJECTION SYSTEM HAVING SUCH A METERING VALVE

(71) Applicant: Robert Bosch GmbH, Stuttgart (DE)

(72) Inventors: Andreas Rehwald, Bietigheim-Bissingen (DE); Prakash Gurushantappa Yadawad, Stuttgart (DE); Rao Bharath Narahari, Mysuru (IN); Sunil Makarabbi, Haveri (IN)

(73) Assignee: Robert Bosch GmbH, Stuttgart (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/179,600

(22) Filed: Nov. 2, 2018

(65) Prior Publication Data

US 2019/0136813 A1 May 9, 2019

(30) Foreign Application Priority Data

Nov. 6, 2017 (DE) ..... 10 2017 219 632

(51) Int. Cl.

| | |
|---|---|
| ***F02M 61/14*** | (2006.01) |
| ***F02M 55/02*** | (2006.01) |
| ***F02M 61/04*** | (2006.01) |
| ***F02M 61/16*** | (2006.01) |
| ***F02M 63/00*** | (2006.01) |
| ***F02M 63/02*** | (2006.01) |

(52) U.S. Cl.

CPC ..... *F02M 61/14* (2013.01); *F02M 55/025* (2013.01); *F02M 61/04* (2013.01); *F02M 61/168* (2013.01); *F02M 63/0031* (2013.01); *F02M 63/0225* (2013.01); *F02M 2200/09* (2013.01); *F02M 2200/853* (2013.01); *F02M 2200/856* (2013.01)

(58) Field of Classification Search

CPC ..... F02M 61/14; F02M 55/025; F02M 61/04; F02M 61/168; F02M 63/0031; F02M 63/0025; F02M 2200/09; F02M 2200/853; F02M 2200/856

See application file for complete search history.

(56) References Cited

U.S. PATENT DOCUMENTS 7,385,335 B2 * 6/2008 Biagetti ..... F02M 51/005 310/328
2019/0136812 A1 * 5/2019 Rehwald ..... F02M 61/14

FOREIGN PATENT DOCUMENTS

DE 102013200993 A1 7/2014

* cited by examiner

*Primary Examiner* — Hieu T Vo
(74) *Attorney, Agent, or Firm* — Norton Rose Fulbright US LLP; Gerard Messina

(57) ABSTRACT

A fuel injection valve of a fuel injection system includes a connector piece that is insertable at least partly into a receiving space of a connector body of a fluid-conveying component. In the installed state a support part is disposed on the connector piece, and the connector piece is mounted via the support part on the connector body. The support part has a spherical support surface with which the support part braces at least indirectly against the connector body in order to implement the mounting of the connector piece directly or indirectly on the connector body.

15 Claims, 7 Drawing Sheets

METERING VALVE FOR METERING A FLUID WHICH SERVES IN PARTICULAR FOR FUEL INJECTION SYSTEMS, MOUNTING SYSTEM FOR INJECTION SYSTEMS, AND INJECTION SYSTEM HAVING SUCH A METERING VALVE

CROSS-REFERENCE TO RELATED APPLICATIONS

The present application claims priority under 35 U.S.C. § 119 to DE 10 2017 219 632.7, filed in the Federal Republic of Germany on Nov. 6, 2017, the content of which is hereby incorporated by reference herein in its entirety.

FIELD OF THE INVENTION

The present invention relates to a metering valve for metering a fluid which serves in particular for fuel injection systems; to a mounting system for injection systems, in particular fuel injection systems, for connecting a metering valve to a fluid-conveying component; and to an injection system having such a metering valve. The invention relates in particular to the field of fuel injection systems for mixture-compressing spark-ignited internal combustion engines.

BACKGROUND

DE 10 2013 200 993 A1 discloses a fuel injection system having a fuel-conveying component, a fuel injection valve, and a mounting system. In the known mounting system, a receiving space, in which a fuel fitting of the fuel injection valve is disposed, is provided inside a cup of the fuel-conveying component. An internal collar is configured on the cup. Also provided is an elastically deformable element that is braced against the internal collar. The fuel fitting is then braced via the elastically deformable element. Mounting of the fuel injection valve on the fuel-conveying component is thereby possible, a reduction in noise being possible as a result of targeted decoupling.

Reducing engine noise is important nowadays not only in terms of noise perceptible in the vehicle interior. In the context of a sales discussion, certain engine noises can be perceived by a customer as undesirable when the engine is idling, especially with the hood open. This relates in particular to metallic transitions in the context of the fuel injection valve mounting system. It can furthermore be assumed that as fuel injection pressure increases, such undesired noises will be at least subjectively perceived to be louder.

SUMMARY

Embodiments of the present invention provide an advantage of enabling improved mounting of the metering valve on the fuel-conveying component. In particular, improved installation at least with reference to suitable application instances can be achieved.

The mounting system and the injection system are suitable especially for applications for fuel injection, in particular direct gasoline injection. The fluid-conveying component is then embodied as a fuel-conveying component. The metering valve is then embodied as a fuel injection valve. The advantages and refinements described with reference to these preferred applications can, however, also correspondingly be utilized generally in a metering valve, in a mounting system for injection systems, and in injection systems.

The fuel-conveying component is preferably embodied for that purpose as a fuel distributor, in particular as a fuel distributor rail. A fuel distributor of this kind can serve on the one hand to distribute fuel to several fuel injection valves, in particular high-pressure injection valves. On the other hand, the fuel distributor can serve as a common fuel reservoir for the fuel injection valves. The fuel injection valves are then preferably connected to the fuel distributor via corresponding mounting systems. During operation, the fuel injection valves then inject the fuel necessary for the combustion operation, at high pressure, into the respective combustion chamber. The fuel is compressed via a high-pressure pump and delivered into the fuel distributor in quantitatively controlled fashion via a high-pressure conduit.

The support part disposed on the connector piece is preferably embodied as a separate support part that can be connected in suitable fashion to the connector piece of the injection valve. In principle, the support part can also be a constituent of the connector piece. The connector body of the fluid-conveying component is not a constituent of the metering valve. The support part of the fuel injection valve can be embodied in terms of at least one specific mounting system, but in this case in particular the fuel injection valve having the support part can also be manufactured and marketed independently of the further constituents of such a mounting system or injection system. The connector body can be a constituent of the fuel-conveying component. In particular, the connector body can be configured as a cup of a fuel distributor. The connector body can, however, also be connected at a later time to a basic body of a fuel distributor, for example by welding. A metering valve according to the present invention and a mounting system according to the present invention can thus also be manufactured and marketed independently of such further constituents, in particular of a basic body of the fuel-conveying component.

In the installed state, the fuel injection valve is connected, preferably by way of a mounting system, to a fluid-conveying component in such a way that the connector piece of the metering valve is inserted at least partly into a receiving space of a connector body of the component. A decoupling element is preferably provided, in the installed state the connector piece being mounted on the connector body by way of the support part, the decoupling element, and a fastening body. It is advantageous that the fastening body has a spherical abutment surface; that the spherical abutment surface of the fastening body faces toward the spherical support surface of the support part; and that the decoupling element is disposed between the spherical support surface of the support part and the spherical abutment surface of the fastening body. The fastening body can be fitted onto the connector body upon installation along a longitudinal axis of the connector body or of the fuel injection valve.

In a variant embodiment, an abutment body on which the spherical abutment surface is embodied can also be placed into the fastening body. In a further possible variant, the spherical abutment surface can also be embodied on an abutment body that is connected in suitable fashion to the connector body of the fluid-guiding component. Statements made with reference to the spherical abutment surface of the fastening body therefore also apply correspondingly to such possible variants.

In a preferred embodiment the fastening body is configured so that its spherical abutment surface is part of a sphere surface or part of a surface of a sphere segment. The spherical support surface of the support part is correspondingly embodied as part of a sphere surface or as part of a surface of a sphere segment. The decoupling element preferably abuts at least largely against the entire spherical abutment surface of the fastening body and/or at least largely against the entire spherical support surface of the support part. Local mechanical loads are thereby reduced. Improved geometric alignment and bracing in different spatial directions can furthermore be achieved. In particular, advantageous alignment and bracing of the fuel injection valve with reference to a longitudinal axis predefined by the connector body can be enabled. This also results in improved positioning of the fuel injection valve in, for example, a cylinder orifice of the internal combustion engine.

The result obtained thereby can be in particular that a direct transfer path between the fuel injection valve and a fuel distributor is absent. Fastening means between the fuel injection valve and the cylinder head, for example bolts that are inserted into elastic bearing bushings for noise insulation, can thereby also be omitted.

It is advantageous that the decoupling element is configured as part of a hollow sphere, in particular as a perforated hollow sphere cap. With this refinement, in particular, an at least approximately constant thickness of the decoupling element in the unloaded state can be defined.

It is advantageous that the decoupling element is constituted at least partly from an elastic material. With this configuration of the decoupling element it is advantageous in particular if the decoupling element is constituted at least partly from at least one elastomer. The decoupling element can be shaped at least partly as a net-shaped part, in particular as a plastic injection-molded part, a thermoplastic elastomer part, a natural rubber part, or a synthetic rubber part, and/or can be cut out from a strip- or plate-shaped precursor material and/or shaped in another manner.

Additionally or alternatively, the decoupling element can be constituted at least partly from a thermoplastic material or a curable plastic material. In particular, the decoupling element can advantageously have a layered structure, in particular a sandwich structure. It is particularly advantageous that the decoupling element has a layered structure, in particular a sandwich structure, having at least one elastic intermediate layer. A layered structure is not necessarily limited in this context to two or three layers. A layered structure in which an elastic layer is located between two non-elastic layers is nevertheless advantageous.

It is advantageous that the decoupling element has a first outer layer that is embodied as a metallic layer or as an at least substantially inelastic plastic layer, and a second outer layer that is embodied as a metallic layer or as an at least substantially inelastic plastic layer; and that the elastic intermediate layer is disposed between the first outer layer and the second outer layer.

This refinement has the particular advantage that both good robustness and an advantageous damping effect can be achieved.

It is advantageous that the decoupling element is configured as a metallic spring element. This refinement has the advantage that a solid and robust configuration of the decoupling element is possible.

An example embodiment provides an advantage that reliable bracing over the service life can be achieved when the fuel injection valve is mounted, for example, via a mounting system on a cup of a component. It is possible in this context, if applicable, to omit an intermaterial joining method, in particular welding, for connecting the support part to the connector piece.

An example embodiment provides an advantage that improved installation and/or improved fitting are made possible. In particular, the support part fitted onto the connector piece can then, in the installed state, when viewed along the longitudinal axis of the connector piece, interact positively on both sides with the connector piece. This makes possible on the one hand simplified installation and on the other hand elimination of additional features for connecting the support part to the connector piece. It is then possible in particular, if applicable, to omit intermaterial joining methods, such as welding, or additional fastening means, such as a retaining ring.

An advantageous configuration of the support part is possible where a radial fitting of the support part onto the connector piece is, in particular, thereby made possible. An example embodiment provides an advantageous configuration for embodying, upon fitting, a connection that is positively engaging when viewed with reference to the longitudinal axis. An example embodiment provides an advantage that installation is conceivable in principle in any possible radial installation direction. Limitations can exist in this context, for example, because of a housing, in particular a plug connector provided on the fuel injection valve, or because of other added parts. The suitable installation direction can then be selected with reference to such limitations, since any desired radial installation on the connector piece itself is possible. Depending on the configuration of the fuel injection valve, this can also make possible greater degrees of freedom when connecting the connector piece to the other constituents of the fuel injection valve.

According to an example embodiment, a connection of the support part to the connector piece of the fuel injection valve is possible. In this context a retaining element, in particular a retaining ring, can be fastened before insertion of the connector piece into the connector body of the component. A retaining ring of this kind is then preferably embodied as an expanding ring; a preferred fastening capability of the expanding ring in a depression on the connector piece is provided according to an example embodiment.

According to an example embodiment, a decoupling element is provided as a constituent of the fuel injection valve. Suitable configurations are conceivable here. In particular, the decoupling element can be provided as a separate decoupling element that is disposed on the spherical support surface of the support part at the latest upon installation. It is also conceivable, however, for the decoupling element to be disposed fixedly on the spherical support surface of the support part.

Preferred exemplifying embodiments of the invention are explained in further detail in the description below with reference to the appended drawings, in which corresponding elements are labeled with matching reference characters.

DETAILED DESCRIPTION

Figure 1:
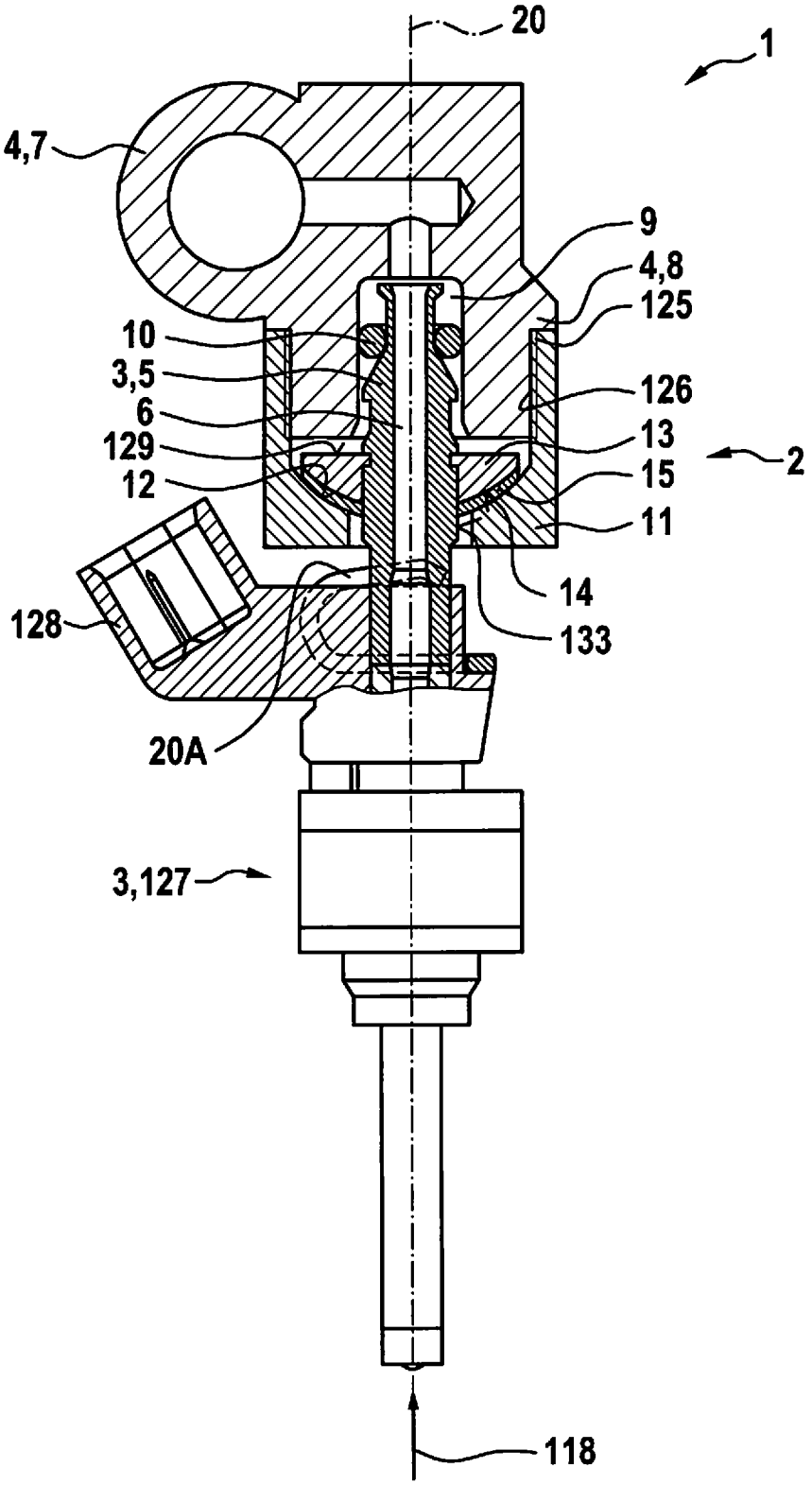
FIG. 1 is a partial schematic sectioned depiction of a fuel injection system having a mounting system, according to an example embodiment of the present invention.

FIG. 1 is a partial schematic sectioned depiction of a fuel injection system 1 having a mounting system 2, in accordance with an exemplifying embodiment. Fuel injection system 1 has a fuel injection valve 3 and a fuel-conveying component 4. Fuel injection valve 3 has a connector piece 5 that encompasses an axial passthrough orifice 6 in order to convey fuel into fuel injection valve 3. In this exemplifying embodiment, fuel-conveying component 4 has a tubular basic body 7 and a connector body 8. In this exemplifying embodiment, connector body 8 is embodied as a cup 8 and has a receiving space 9. Connector piece 5 is inserted at least partly into receiving space 9 of connector body 8. Fuel sealing is ensured in this context by way of a sealing ring 10.

A fastening body 11, on which a spherical abutment surface 12 is embodied, is furthermore installed. A support part 13 that is connected to connector piece 5 is furthermore disposed on connector piece 5. In a modified embodiment, support part 13 can in principle also be a constituent of connector piece 5. A spherical support surface 14 is embodied on support part 13. Spherical abutment surface 12 of fastening body 11 faces toward spherical support surface 14. Fastening body 11, embodied as fastening nut 11, has an internal thread 125 with which fastening body 11 is screwed onto an external thread 126 of connector body 8. Spherical support surface 14 is thus embodied on support part 13 in such a way that said surface in the installed state faces toward spherical abutment surface 12, and so that in the installed state, mounting of connector piece 5 at least indirectly on connector body 8 of component 4, via spherical support surface 14 of the support part, is possible.

In the installed state, a decoupling element 15 is disposed between spherical abutment surface 12 of fastening body 11 and spherical support surface 14 of support surface 13. Decoupling element 15 preferably abuts substantially against the entire spherical abutment surface 12 and/or at least substantially against the entire spherical support surface 14, so that at least substantially full-coverage abutment of decoupling element 15 on both sides, respectively against spherical abutment surface 12 and spherical support surface 14, is produced.

In the installed state, fuel injection valve 3 is then aligned with reference to a longitudinal axis 20, predefined by connector body 8, of receiving space 9. Reliable positioning of fuel injection valve 3 in a cylinder-head orifice can correspondingly be accomplished, for example. Mounting system 2 makes additional fastening or bracing (by way of a metallic contact) of fuel injection valve 3 against the cylinder head superfluous. Transfer of vibrations between fuel injection valve 3 and the cylinder head is thereby, in particular, avoided. Insulation of fuel injection valve 3 from connector body 8 and thus from fuel-conveying component 4 is furthermore provided by decoupling element 15. This reduces or prevents, in particular, the transmission of solid-borne sound. An elastic retaining clamp 20A, which braces against a housing 127 of fuel injection valve 3, can be installed between connector body 8 and fuel injection valve 3. An electrical plug connector 128 is shaped onto housing 127.

Figure 2:
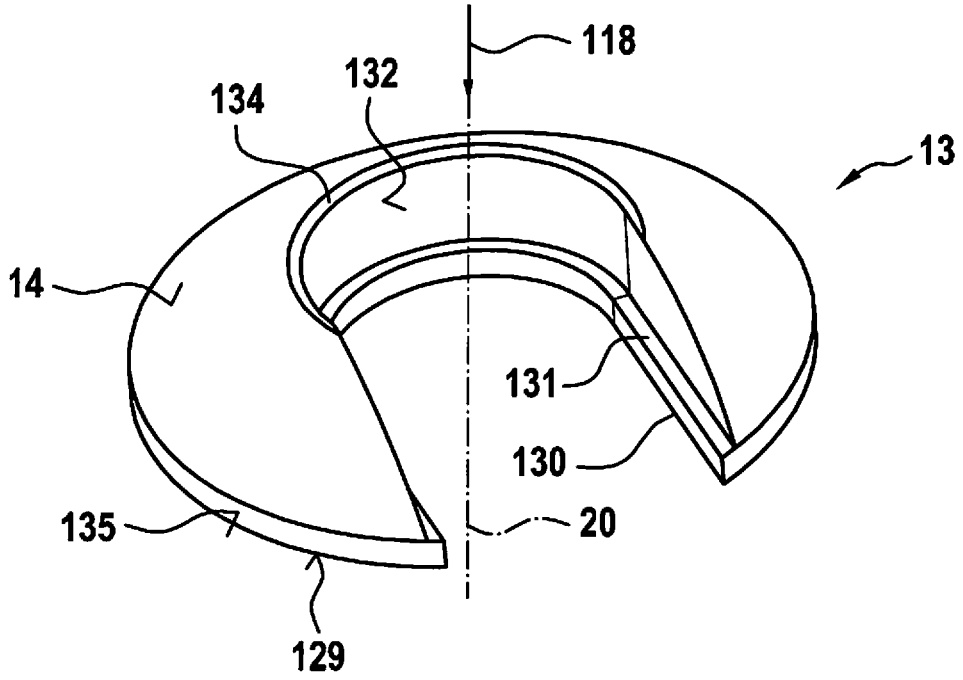
FIG. 2 shows a support part of a fuel injection valve for the fuel injection system depicted in FIG. 1, according to an example embodiment of the present invention.

FIG. 2 shows support part 13 of fuel injection valve 3 in accordance with the exemplifying embodiment depicted in FIG. 1. An installation location of support part 13 is defined here by axial installation direction 118, also depicted in FIG. 1, in which fuel injection valve 3 is inserted with its connector piece 5 into connector body 8 of component 4. In the context of this insertion operation, support part 13 is already located on connector piece 5. In the installed state, support part 13 is then secured by connector body 8 that surrounds support part 13.

Spherical support surface 14 of support part 13 is oriented oppositely to axial installation direction 118. Support part 13 furthermore has a side 129, facing away from spherical support surface 14, which can be of flat configuration. Side 129 is oriented perpendicularly to longitudinal axis 20 and in the direction of axial installation direction 118.

Support part 13 has a U-shaped recess 130 that is configured so that upon installation, connector piece 5 is insertable into U-shaped recess 130 radially with respect to longitudinal axis 20 of connector piece. In other words, U-shaped recess 130 is configured so that upon installation, support part 13 is fittable onto connector piece 5 of fuel injection valve 3 in a manner corresponding to what is also described with reference to FIGS. 6A and 6B.

Support part 13 has a connecting rib 131 that is configured in this exemplifying embodiment as a U-shaped connecting rib 131. Connecting rib 131 is provided on U-shaped recess 130 of support part 13. Support part 13 furthermore has, on U-shaped recess 130, an inner side 132 that is configured as part of a cylindrical enveloping surface. In particular, inner side 132 can be configured as half of a cylindrical enveloping surface. In the installed state, support part 13 abuts with its inner side 132 preferably against an outer side 133 of connector piece 5 of fuel injection valve 3, as depicted in FIG. 1. Support part 13 furthermore has a rounded transition 134 from spherical support surface 14 to inner side 132. A partially annular outer side 135 of support part 13 is preferably located in a cylindrical enveloping surface. Outer side 135 is interrupted by U-shaped recess 130.

Figure 3:
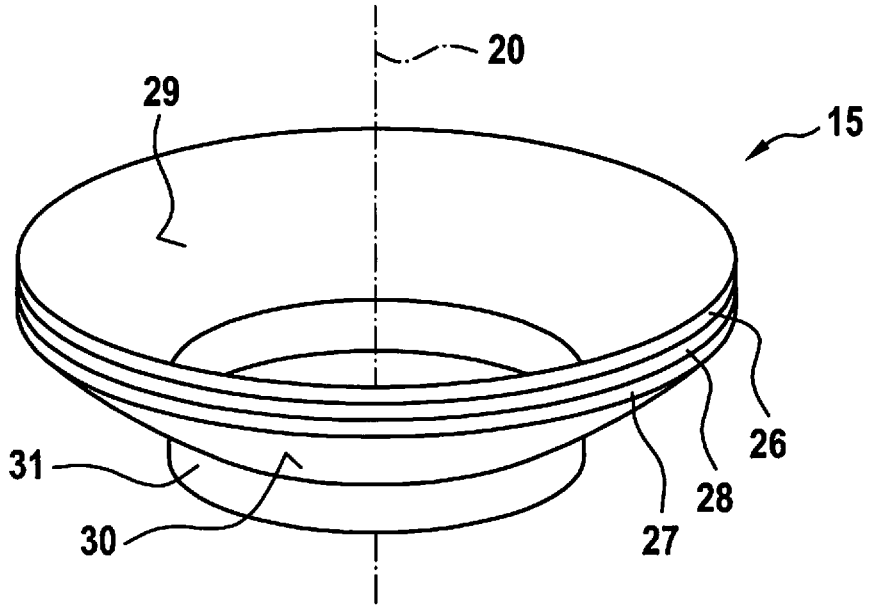
FIG. 3 shows a decoupling element of the mounting system depicted in FIG. 1, in a configuration according to an example embodiment of the present invention.

FIG. 3 is a schematic three-dimensional depiction of the mounting system depicted in FIG. 1, in accordance with a first possible embodiment. In this embodiment, layers 26, 27, 28 are provided. Layer 28 is preferably embodied as an elastic intermediate layer in order to enable a sandwich structure. Layer 26 serves here as a first outer layer 26, and layer 27 serves as a second outer layer 27. Layers 26, 27 are preferably embodied as metallic layers 26, 27 and/or as at least substantially inelastic plastic layers. Improved stability at an outer side 29 of layer 26 and at an outer side 30 of layer 27 can thereby, in particular, be achieved. Outer side 29 abuts in the installed state against spherical support surface 14 of support part 13. Outer side 30 abuts in the installed state against spherical abutment surface 12 of fastening body 11. A collar 31, which surrounds connector piece 5 in portions in the installed state, can also be shaped onto decoupling element 15 in order also to ensure insulation with respect to fastening body 11 in a radial direction with reference to longitudinal axis 20. Collar 31 can furthermore ensure positioning of decoupling element 15 on fastening body 11.

Figure 4:
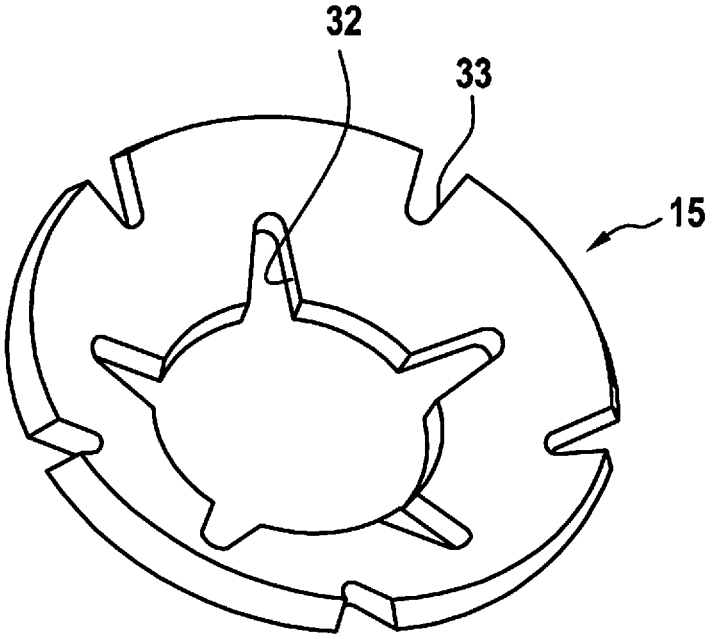
FIG. 4 shows a decoupling element of the mounting system depicted in FIG. 1, in a configuration according to another example embodiment of the present invention.

FIG. 4 shows the decoupling element depicted in FIG. 3 in accordance with a second possible embodiment. In this embodiment, decoupling element 15 is configured as a metallic spring element 15. Recesses (of which only recesses 32, 33 are labeled in order to simplify the depiction) can be provided on decoupling element 15 in addition to a three-dimensional configuration in order to define the elastic effect desired in the particular application instance, in particular a spring constant.

Figure 5:
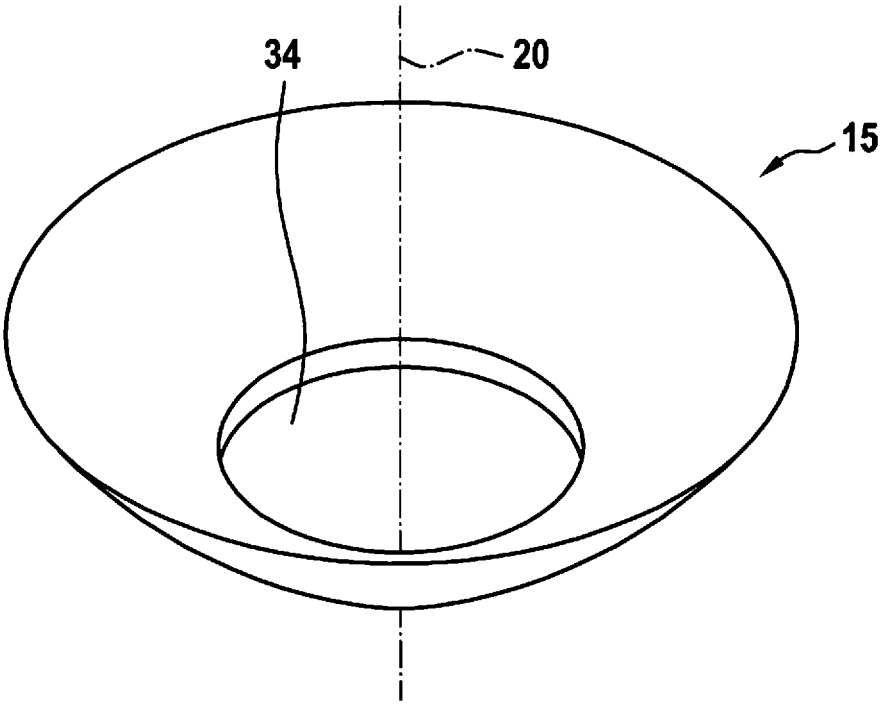
FIG. 5 shows a decoupling element of the mounting system depicted in FIG. 1, in a configuration according to another example embodiment of the present invention.

FIG. 5 shows the decoupling element depicted in FIG. 3 in accordance with a third possible configuration. Decoupling element 15 can be configured here, for example, as a shaped element generated in a tool. An axial opening 34, which can be of circular configuration and is oriented with reference to longitudinal axis 20 defined in the installed state, can also be embodied, for example, by punching.

Several possibilities therefore exist for configuring a decoupling element 15 in terms of the respective application instance. A layered structure having two or more layers, one of which is described with reference to FIG. 2, can be implemented. Different materials can thereby advantageously be combined. For example, metallic materials and plastics can be combined. A thermoplastic, a thermoplastic elastomer, a natural rubber, and a synthetic rubber can be utilized for an elastic layer, in particular an elastic intermediate layer as explained in FIG. 3 with reference to layer 28, or also in the context of an embodiment made of a single material as described with reference to FIG. 5. A (non-layered) material composition can also be used as a material in this context. In addition, decoupling element 15 does not necessarily need to be installed as a separate constituent upon installation. Decoupling element 15 can, in particular, already be joined onto support part 13 or onto fastening body 11. Intermaterial connection or injection application of decoupling element 15 onto support part or onto fastening body 11 is also conceivable. Decoupling element 15 can also, if applicable in interaction with an elastic sealing ring 10, make possible a certain tolerance compensation for positional deviations of fuel injection valve 3 from longitudinal axis 20. This relates in particular to tilts and to a coaxial offset. Damage to fuel injection valve 3 as a result of flexural forces or the like is thus prevented.

Figure 6A:
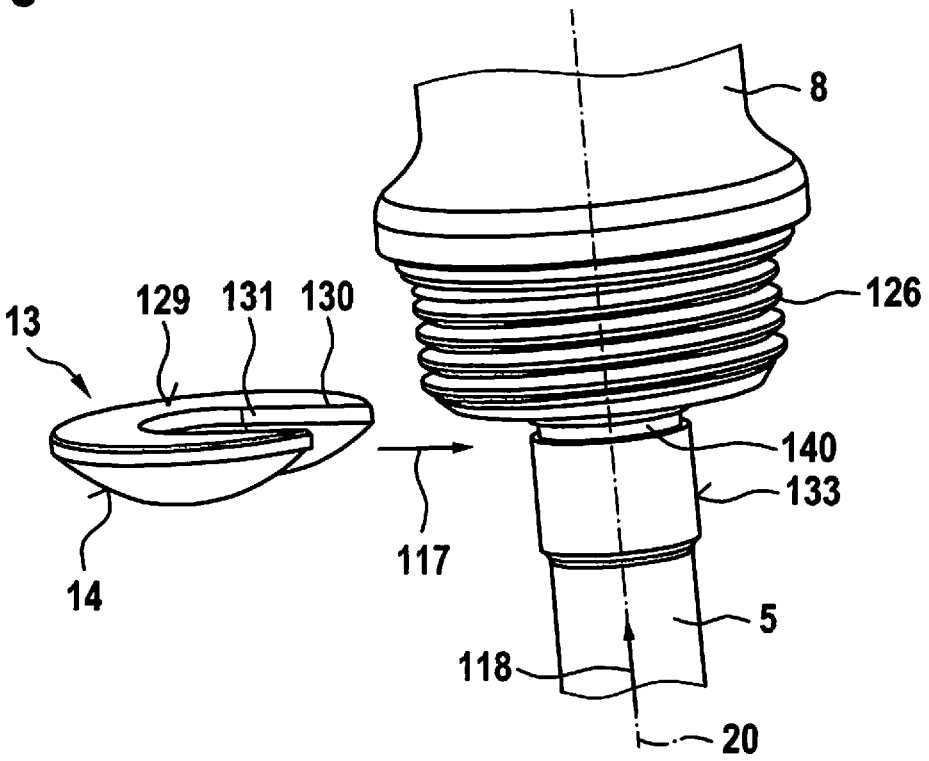
FIG. 6A is a partial depiction of the mounting system depicted in FIG. 1, upon installation, according to an example embodiment of the present invention.
Figure 6B:
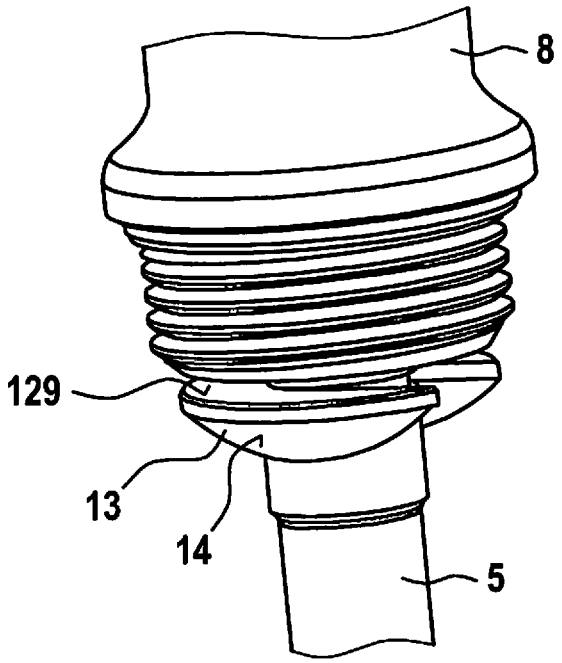
FIG. 6B is a partial depiction of the mounting system depicted in FIG. 1, upon installation, according to an example embodiment of the present invention.

FIG. 6A is a partial depiction of the mounting system depicted in FIG. 1 upon installation of support part 13, depicted in FIG. 2, onto connector piece 5 of fuel injection valve 3. FIG. 6B is furthermore a partial depiction of mounting system 2 depicted in FIG. 1 upon installation, support part 13 depicted in FIG. 2 already being fitted onto connector piece 5 of fuel injection valve 3 before connector piece 5, having support part 13, is inserted into connector body 8 of component 4 in axial installation direction 118. Fastening body 11 is not depicted here in order to simplify the depiction. Also in order to simplify the depiction, only connector piece 5 is depicted with reference to fuel injection valve 3. Upon installation, connector piece 5 of fuel injection valve 3 does not necessarily already need to be inserted somewhat into connector body 8 of component 4. In particular, a pre-installation can be accomplished in which firstly support part 13 and fastening body 11 are disposed on connector piece 5 of fuel injection valve 3, and connector piece 5 is connected to housing 127 of fuel injection valve 3.

A depression 140 is configured on connector piece 5. In this exemplifying embodiment, depression 140 is embodied as an annular groove 140 that is circumferential with reference to longitudinal axis 20. For installation of support part 13 onto connector piece 5, support part 13 is positioned next to connector piece 5, with reference to axial installation direction 118 that is provided for subsequent installation of fuel injection valve 3 onto connector body 8 of component 4, in such a way that side 129 of support part 13 is oriented perpendicularly to longitudinal axis 20 and points in axial installation direction 118, while spherical support surface 14 is oriented oppositely to axial installation direction 118. Support part 13 is then furthermore fitted onto connector piece 5, with U-shaped recess 130 open toward connector piece 5, in a radial installation direction 117 that is perpendicular to longitudinal axis 20, in such a way that connecting rib 131 engages into depression 140 of connector piece 5. Fitting in radial installation direction 117 is performed until support part 13 abuts with its inner side 132 against outer side 133 of connector piece 5, as depicted in FIG. 6B.

Fastening body 11 is not necessarily connected to connector body 8 via a threaded connection that is illustrated by threads 125, 126. A segmented configuration of fastening body 11 is, in particular, also conceivable; segments, in particular halves, of fastening body 11 can likewise be installable in a radial direction with respect to longitudinal axis 20. Different sequences upon installation of fuel injection valve 3 onto component 4 can thereby be made possible.

Figure 7:
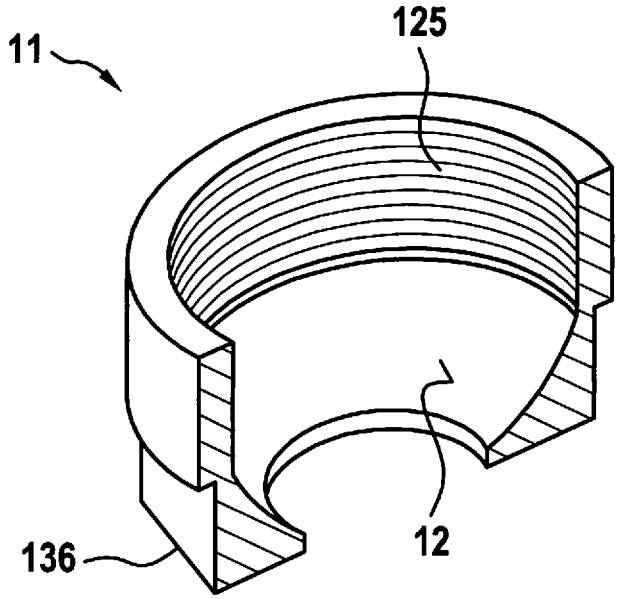
FIG. 7 is a three-dimensional sectioned depiction of a fastening body of the mounting system depicted in FIG. 1, according to an example embodiment of the present invention.
Figure 8:
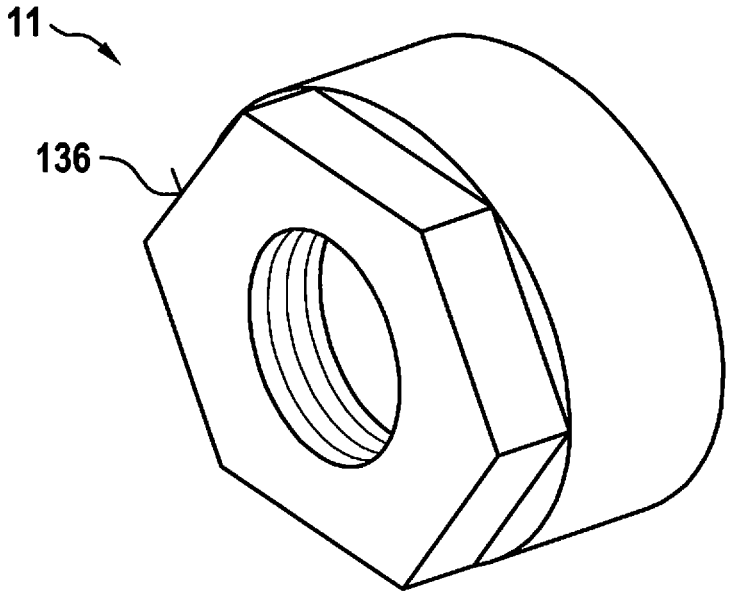
FIG. 8 is a three-dimensional depiction of a fastening body of the mounting system depicted in FIG. 1, according to an example embodiment of the present invention.

FIG. 7 is a three-dimensional sectioned depiction of fastening body 11 of mounting system 2 depicted in FIG. 1. In this exemplifying embodiment, fastening body 11 has spherical abutment surface 12. In the installed state, decoupling element 15 is then located between spherical support surface 14 of support part 13 and spherical abutment surface 12 of fastening body 11. In this exemplifying embodiment, inner thread 125 is also shown as a possible embodiment for enabling a connection of fastening body 11 to connector body 8. A polygonal contour 136, which allows an installation tool to be put in place, is embodied on fastening body 11 in order to screw on fastening body 11. FIG. 8 shows, in this regard, fastening body 11 in a different perspective from which polygonal contour 136 is apparent.

Figure 9:
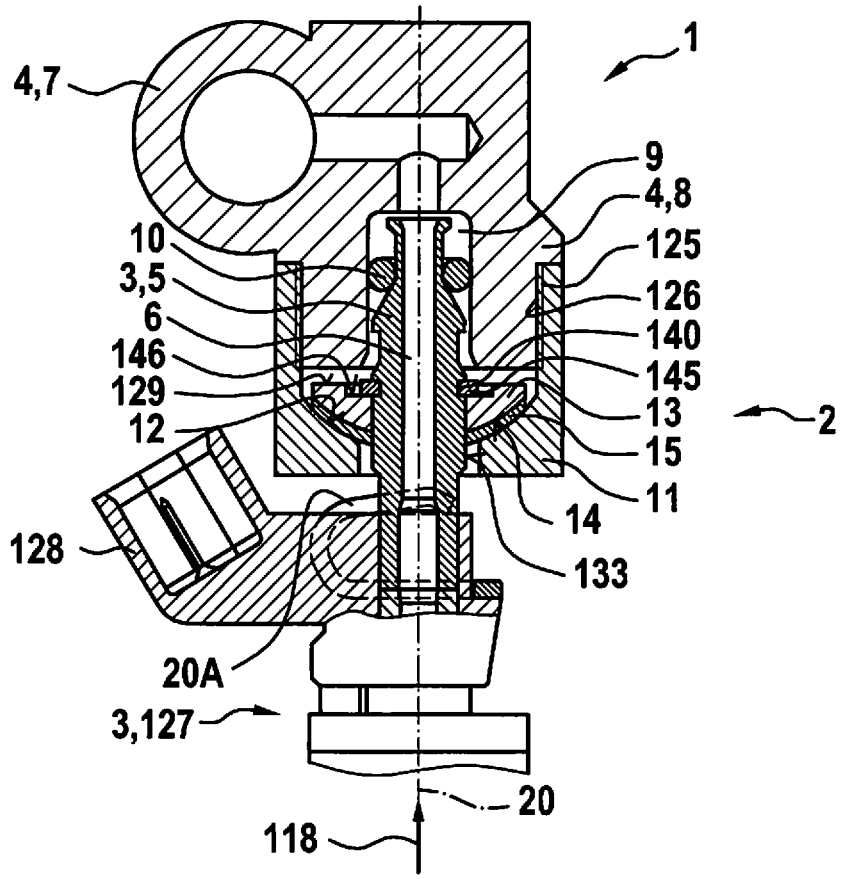
FIG. 9 is a partial schematic sectioned depiction of a fuel injection system having a mounting system, according to an example embodiment of the present invention.

FIG. 9 is a partial schematic sectioned depiction of a fuel injection system 1 having a mounting system 2, in accordance with a further exemplifying embodiment. In this exemplifying embodiment, support part 13 is retained via a retaining element 145 on connector piece 5 of fuel injection valve 3, and thus fastened at least in the installed state. Retaining element 145 is preferably embodied as a retaining ring 145 that engages into depression 140, embodied as a circumferential groove 140, of connector piece 5.

Figure 10:
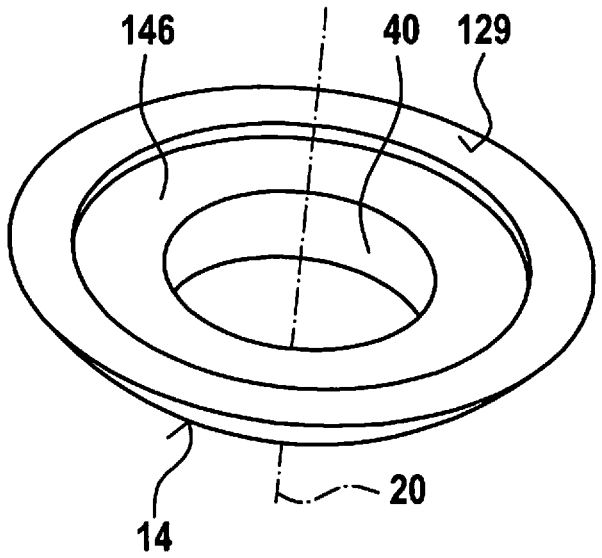
FIG. 10 is a three-dimensional depiction of a support part of a fuel injection valve for the fuel injection system depicted in FIG. 9, according to an example embodiment of the present invention.

FIG. 10 shows support part 13 of mounting system 2 depicted in FIG. 9, in accordance with the further exemplifying embodiment. Support part 13 has a passthrough orifice 40 through which connector piece 5 of fuel injection valve 3 extends in the installed state. Passthrough orifice 40 is configured as an axial passthrough orifice 40 with reference to longitudinal axis 20 predefined by installation. In this exemplifying embodiment, support part 13 is configured annularly with reference to longitudinal axis 20. On side 129, support part 13 has a depression 146 in which retaining element 145, embodied as retaining ring 145, is at least partly countersunk in the installed state.

Figure 11:
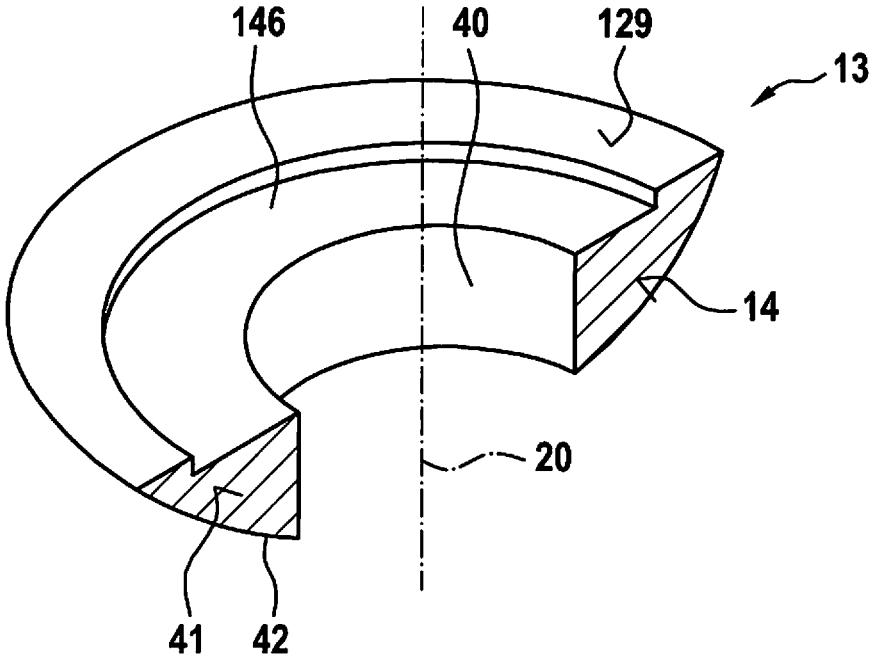
FIG. 11 is a three-dimensional sectioned depiction of a support part of a fuel injection valve for the fuel injection system depicted in FIG. 9, according to an example embodiment of the present invention.

FIG. 11 is a three-dimensional sectioned depiction of support part 13 depicted in FIG. 10, longitudinal axis 20 being located in the section plane. Support part 13 is preferably configured with a profile 41 that is uniform in a circumferential direction. A side 42 of profile 41 which adjoins spherical support surface 14 is then embodied in the shape of a circular arc.

Figure 12:
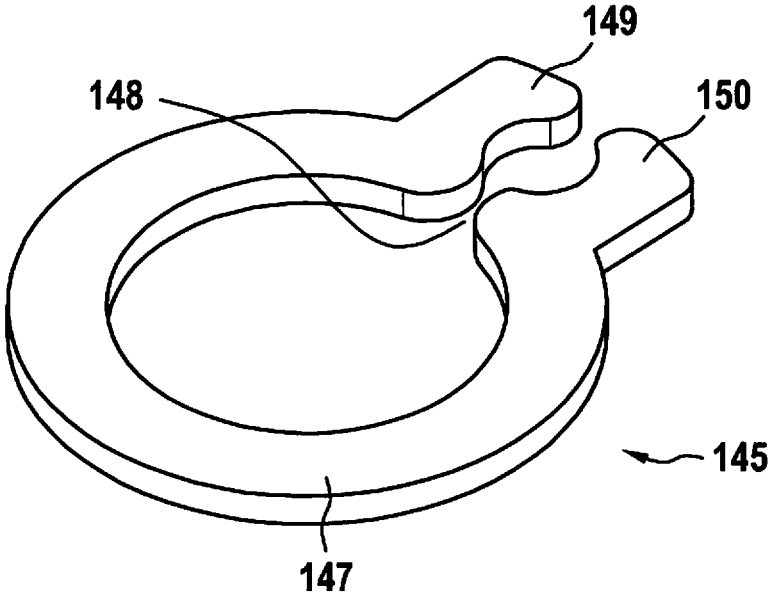
FIG. 12 is a three-dimensional depiction of a retaining element, embodied as an expanding ring, for the mounting system depicted in FIG. 9, according to an example embodiment of the present invention.

FIG. 12 is a three-dimensional depiction of the retaining element, embodied as expanding ring 145, for mounting system 2 depicted in FIG. 9. Retaining element 145 has an annular basic body 147 that is open at a point 148. Lugs 149, 150 that allow placement of a spreading tool are provided in the region of point 148. The annular basic body 147 can thereby be spread apart in order to install retaining element 145 onto connector piece 5 of fuel injection valve 3.

The embodiment described with reference to FIGS. 9-12 has the advantage that simple installation and fastening of support part 13 on connector piece 5 is possible. This applies in particular to a pre-installation operation in which connector piece 5 is already connected to housing 127. Fastening body 11 and support part 13 can then be fitted onto connector piece 5 oppositely to axial installation direction 118. Retaining element 145 can then be connected to connector piece 5. A decoupling element 115 is preferably inserted in this context between support part 13 and fastening body 11. Those components are then reliably secured on fuel injection valve 3. In order to fasten fuel injection valve 3 onto connector body 8 of component 4, connector piece 5 can then be inserted in axial installation direction 118 into connector body 8 of component 4, and fastening body 11 can be connected, in particular bolted, to connector body 8.

The invention is not limited to the embodiments described.

What is claimed is:

1. A fluid metering valve comprising:
a support that includes a spherical support surface; and
a connector:
that is insertable at least partly into a receiving space of a connector body of a fluid-conveyor;
on which the support is configured to be disposed in an installed state; and
that is mountable on the connector body in the installed state via the support with its spherical support surface directly or indirectly against the connector body.

2. The metering valve of claim 1, wherein, in the installed state, the support interacts positively with the connector at least on one side when viewed along a longitudinal axis of the connector.

3. The metering valve of claim 1, wherein the support is fittable onto the connector radially with respect to a longitudinal axis of the connector.

4. The metering valve of claim 1, wherein the support has a U-shaped recess that is configured so that the connector is insertable into the U-shaped recess radially with respect to a longitudinal axis of the connector.

5. The metering valve of claim 4, wherein the support has on the U-shaped recess a U-shaped connecting rib that is configured so that upon assembly the connecting rib engages into at least one depression configured on the connector.

6. The metering valve of claim 5, wherein the depression configured on the connector piece is embodied as a circumferential annular groove.

7. The metering valve of claim 1, wherein, in the installed state, the support is fastened on the connector via a retainer.

8. The metering valve of claim 1, wherein, in the installed state, the support is fastened on the connector via an expanding ring.

9. The metering valve of claim 1, wherein the support has a depression into which a retainer is at least partly inserted in the installed state.

10. The metering valve of claim 1, wherein the support has a depression into which an expanding ring is at least partly inserted in the installed state.

11. The metering valve of claim 1, further comprising an at least partly spherically shaped decoupler that, in the installed state, abuts against the spherical support surface of the support, wherein the connector is mountable at least indirectly on the connector body via the support and the decoupler.

12. The metering valve of claim 1, wherein the fluid metering valve is configured to meter fuel of a fuel injection system.

13. A mounting system mounting a fluid metering valve on a connector body of a fluid-conveyor of a fuel injection system, wherein the fluid metering valve includes:
a support that includes a spherical surface; and
a connector:
that is insertable at least partly into a receiving space of the connector body;
on which the support is configured to be disposed in an installed state; and
that is mountable on the connector body in the installed state via the support bracing with its spherical support surface directly or indirectly against the connector body.

14. An injection system comprising:
a fluid-conveyor; and
a metering valve that includes:
a support that includes a spherical surface; and
a connector:
that is insertable at least partly into a receiving space of a connector body of the fluid-conveyor;
on which the support is configured to be disposed in an installed state; and
that is mountable on the connector body in the installed state via the support bracing with its spherical support surface directly or indirectly against the connector body.

15. The injection system of claim 14, wherein the injection system is configured for fuel injection of a mixture-compressing spark-ignited internal combustion engine.

* * * * *